United States Patent [19]

Danko et al.

[11] Patent Number: 4,756,701

[45] Date of Patent: Jul. 12, 1988

[54] METHOD OF MAKING A TUNGSTEN-HALOGEN LAMPS HAVING AN ENHANCED TEMPERATURE GRADIENT

[75] Inventors: George K. Danko, Moreland Hills; Ronald J. Olwert, Concord Township, Lake County, both of Ohio

[73] Assignee: General Electric Company, Schenectady, N.Y.

[21] Appl. No.: 875,920

[22] Filed: Jun. 19, 1986

[51] Int. Cl.[4] ..... H01J 61/33; H01J 9/34; H01J 9/26

[52] U.S. Cl. ..... 445/22; 313/569; 313/579; 313/634; 445/27

[58] Field of Search ..... 313/579, 634, 569, 315; 445/22, 27

[56] References Cited

U.S. PATENT DOCUMENTS

| | | | |
|---|---|---|---|
| 4,331,901 | 5/1982 | de Vrijer et al. | 313/315 |
| 4,434,386 | 2/1984 | Lowe | 445/22 X |
| 4,535,269 | 8/1985 | Tschetter et al. | 313/579 |

*Primary Examiner*—Palmer C. DeMeo

*Attorney, Agent, or Firm*—John P. McMahon; Philip L. Schlamp; Fred Jacob

[57] ABSTRACT

Incandescent lamps having an improved light source are disclosed. The light source contains a halogen compound along with a fill-gas at a pressure above atmospheric. The light source has an oblate ellipsoidal shape so as to obtain a desired temperature gradient which reduces typically experienced "cold spots" that detrimentally contribute to the condensation of halogen compounds within the light source which would otherwise reduce the desired light output of the light source throughout life. Also disclosed is a method of manufacturing the light source.

1 Claim, 2 Drawing Sheets

Fig. 1
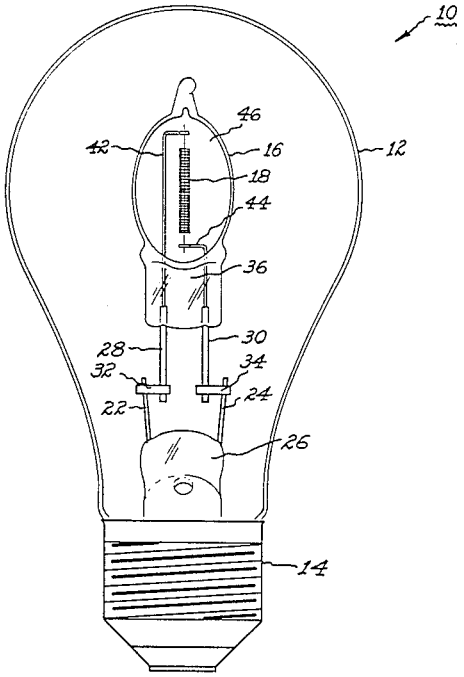
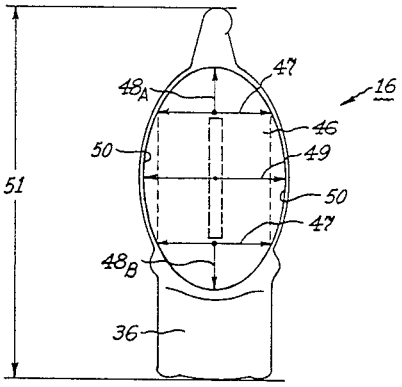
Fig. 2

STEP (a)

STEP (b)

STEP (c)

STEP (d)

STEP (e)

STEP (f)

STEP (g)

METHOD OF MAKING A TUNGSTEN-HALOGEN LAMPS HAVING AN ENHANCED TEMPERATURE GRADIENT

BACKGROUND OF THE INVENTION

The present invention relates to a general service incandescent lamp, and more particularly, to a general service incandescent lamp having a light source with an enhanced temperature gradient.

Light sources containing a filament, a halogen compound along with a relatively high pressure fill-gas have relatively recently been implemented for incandescent type lamps, and provide increased light output relative to that of the common incandescent lamps filaments.

The implementation of the light source operated at a relatively high pressure must take into account the highest or maximum operating temperature which if equalled or exceeded correspondingly causes the envelope of the light source to soften, obtain a plastic-like state, deform and become inoperative. The maximum operating temperature of the envelope of the light source is determined, in part, by commonly known "hot spots" typically located directly above and at the center of the operating filament.

As the wattage desired for the incandescent lamp increases, the operating temperature of the inner envelope of the light source is increased which commonly requires an increase in the diameter of the envelope creating certain disadvantages.

One of the disadvantages of such an increase is the difficulty experienced in the pinching process in which one end of the inner envelope, having spatially disposed therein the filament and associated structural members, is pinched and sealed. Increasing the diameter of the envelope of the light source increases the mass to be pinched and sealed, which correspondingly prolongs the pinch and seal process and in certain cases hinders the attainment of a proper seal.

Increasing the diameter of the envelope may also create a problem associated with "cold spots". The "cold spots" are those locations within the inner envelope, typically in the corners of the inner envelope and at distances most remote from the operating filament, which allow the halogen compound within the confines of envelope to condense in the "cold spots" which, in turn, reduces the contribution of the halogen compound related to maintaining the desired light output of the light source.

Increasing the diameter of the envelope also increases its mass which increases the difficulty of mounting the light source within an outer envelope of the lamp in which the light source is employed. Further, the increased mass disadvantageously adds to the cost of the light source. Furthermore, the increased mass disadvantageously adds to the stored energy that may need to be contained under an unlikely rupture condition of the light source.

The present invention increases the temperature of the cold spots to acceptable levels without decreasing the diameter of the inner envelope. These acceptable levels are primarily provided by a light source having a desired inner walls temperature gradient. The light source increases the operating temperature typically experienced at the cold spot locations and thereby reduces the temperature gradient between the hot and cold spots. The present invention also provides an improved method for forming the desired light source.

Accordingly, objects of the present invention are (1) maintaining the maximum diameter of the light source while reducing the temperature gradients of the typically experienced hot and cold spots, (2) maintaining the diameter of the light source so as to facilitate the pinch and seal processes, and (3) providing a light source having a desired temperature gradient while at the same time reducing the complexity of the mounting structure of the light source within the outer envelope of the lamps employing the light source.

These and other objects of the present invention will become apparent upon consideration of the following description taken together with the accompanying drawing.

SUMMARY OF THE INVENTION

The present invention is directed to incandescent lamps having a light source with an enhanced temperature gradient. The light source is spatially disposed and supported within the outer envelope of the lamp. The light source has a filament disposed therein and contains a halogen compound along with a high pressure fill-gas.

In accordance with one embodiment of the present invention, the light source is used within a general service incandescent lamp comprised of an outer envelope and an electrically conductive base that may be sealed thereto. The light source is formed of a light-transmissive material. The light source has an oblate ellipsoidal shape and contains a halogen compound, a fill-gas, along with a filament spatially disposed and supported therein. The light source has a first predetermined diameter related to both its upper and lower inner wall portions. The surfaces of the upper walls are joined by a first predetermined radius of curvature, whereas, the surfaces of the lower walls are joined by a second predetermined radius of curvature. The light source further has a minor axis with a second predetermined diameter related to the central portion of its side walls. The upper, side and lower walls are joined together with a contoured shape. The overall shape of light source is effective to provide a desired temperature gradient and operating temperature within its chamber during operation of the light source for its halogen compound.

The present invention also comprises a method of manufacture of the light source. The method comprises steps of providing a light-transmissive first tubular member opened at both ends having the first predetermined diameter and which member is to substantially form the inner envelope. Also provided is a light-transmissive second tubular member open at both ends and which member is to serve as the exhaust tube during the manufacture of the light source. Further provided is a filament which is supported by structural members and which is to be axially disposed within the inner envelope. The first member is heated so as to soften and to close the upper portion into a dome-like shape with a radius of curvature substantially corresponding to the first predetermined radius of curvature. The lower portion of the second member is mated with the dome portion of the first member and the mated portions are heated thereby fusing them together as a composite member. The composite member is preheated to a predetermined temperature range and then placed into a mold having side portions each with a contoured shape which is substantially the same as the contoured shape which joins the upper side and lower walls of the light source. The mold further has a closed portion which complementary mates with the lower open portion of the composite member. The mold is then closed while at substantially the same time an inert gas is applied having a sufficient pressure to cause the composite member to expand and to take the shape of the contoured shape of the mold. The composite member is then removed from the mold and the filament along with its structural members are inserted into the central portion of the composite member. Heat, at a predetermined temperature, is applied to the low neck portion of the composite member while at the same time a cover gas is applied, flows over and prevents oxidation of the filament. The lower neck portion of the composite member is then placed into a pinch mold having an upper portion with a predetermined radius of curvature corresponding to the second predetermined radius of curvature of the light source. The pinch mold is closed causing the pinching of the composite member and the sealing of the structural members of the filament assembly within the pinch seal, while at the same time a cover gas at a sufficient pressure is puffed through the upper open portion of the composite member so that the lower portion of the composite member takes the shape of the predetermined radius of curvature of the pinch mold. The composite member is then removed from the mold and after exhausting and then filling the inner confines of the composite member with the halogen compound and fill-gas, heat is then applied to the fused portion of the composite member causing the upper portion of the composite member to be severed. The remaining portion of the composite member forms the light source.

BRIEF DESCRIPTION OF DRAWING

FIG. 1 illustrates an improved general service incandescent lamp in accordance with one embodiment of the present invention.

FIG. 2 illustrates the oblate ellipsoidal shape light source of the present invention.

DETAILED DESCRIPTION OF THE PREFERRED EMBODIMENTS

Figure 3A:
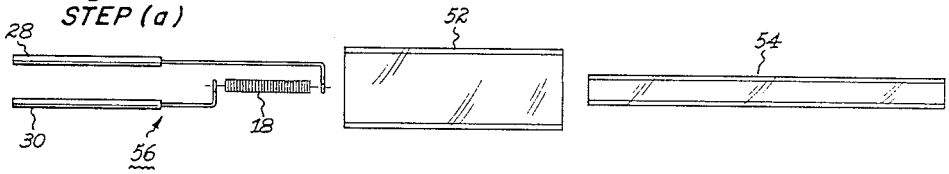
FIG. 3 illustrates a method of manufacture of the light source of the present invention.

FIG. 1 illustrates an improved general service incandescent lamp 10 in accordance with one embodiment of the present invention. The lamp 10 comprises an outer envelope 12 which is preferably sealed to an electrically conductive base 14. The outer envelope 12 may be filled with an inert gas or it may be evacuated. If desired, the outer envelope 12 may have its inner confines exposed to the outside ambient and therefore not sealed to the base 14. The outer envelope 12 is formed of a light-transmissive material such as glass and for the embodiment shown in FIG. 1 has a shape typically known as A-line. For other embodiments the outer envelope may have various shapes such as the well-known shapes of Parabolic Aluminized Reflector (PAR) and Reflector lamps.

FIG. 1 further shows lamp 10 as comprising a light-transmissive inner envelope or light source 16 which contains a halogen compound along with fill-gas of a pressure above atmospheric. The fill-gas may be selected from the group consisting of xenon, krypton, argon, nitrogen and mixtures of these gases with nitrogen. The inner envelope may be a single-ended or double-ended type and formed of quartz or glass tubing. The glass may be of a low sodium high temperature, impervious to hydrogen, such as #180 type glass available from the Lighting Business Group of Cleveland, Ohio, of the General Electric Company.

The light source 16 preferably has a tungsten filament 18 supported and spatially disposed therein in a longitudinal manner along the axis of lamp 10. The filament 18 can be of a triple coiled, coiled-coil or single coil type and have parameters selected for activation by a typical 120 volt A.C. household power. Further, the practice of the invention also contemplates use of a filament operated at a low voltage such as in the range of about 12 to about 92 volts. The low voltage filament 18 may be specially adapted to be effectively energizable for normal operating wattage rating at a reduced voltage relative to the typical household power source. The filament 18 lodged within the light source 18 may also find application in the automotive and photographic fields and have parameters selected accordingly. For such applications the related lamps need to provide appropriate mounting means for the light source 16.

The general service incandescent lamp 10 of FIG. 1 includes two electrically conductive support members 22 and 24 which are rigidly supported within the outer envelope 12 by a stem 26. One end of each of the support members 22 and 24 extends through the stem 26 and makes electrical connection with appropriate electrical contact portions of the electrically conductive base 14. The other ends of the support members 22 and 24 are respectively connected to inleads 28 and 30 by electrically conductive cross members 32 and 34. The light source 16 has a pinch 36 at its lower portion which seals the members 32 and 34 therein.

A light source formed of a quartz material preferably has two foil-members, whereas, in light source formed of a glass material the members 28 and 30 may have rod-like shapes and extend through the seal 36 and connected to the filament 18 without the need of the foil-member 38 and 40. For the embodiment shown in FIG. 1, the filament 18 is connected across electrical members 42 and 44.

The light source 16 has an inner chamber 46 which is of prime importance to the present invention and shown in an enlarged manner in FIG. 2. FIG. 2 for clarity purposes shows the inner chamber 46 as having the filament 18, shown in phantom, spatially disposed therein and not having any structural members attached thereto. The light source 16 has an oblate ellipsoidal shape. The inner chamber 46 of light source 16 has a first predetermined diameter 47 related to both its upper and lower inner wall portions. The surfaces of the upper walls are joined by a first predetermined radius of curvature $48_A$, whereas, the surfaces of the lower walls are joined by a second predetermined radius of curvature $48_B$. The radii of curvatures $48_A$ and $48_B$ may be a typical value of a ratio of the diameter 47 and extend from the center of the diameter 47. The light source 16 has a minor axis with a second predetermined diameter 49 related to the central portion of its side walls. The upper, side and lower walls are brought together or joined in a continuous relatively smooth manner by a contoured shape 50. The light source 16 has an length 51. The pinch 36 of light source 16 has a diameter which substantially corresponds to the first predetermined diameter 47 which, in turn, corresponds to the initial diameter of light source 16 in its unblown state to be discussed hereinafter with regard to the method of the present invention.

As discussed in the "BACKGROUND" a light source having a filament and containing a halogen compound along with a high pressure fill gas typically experiences problems related to "hot spots" and "cold spots." Further, the light source has an upper or maximum operating temperature limitation which when equalled or exceeded may cause the envelope to soften, obtain a plastic-like state, deform and become inoperative.

The "hot spots" within the inner envelope are commonly located directly above and at the center of the filament and are deterministic of the maximum operating temperature of the inner envelope, whereas, the "cold spots" are typically encountered at the locations most remote from the operating filament, commonly found in the corners of the inner envelope, and have temperatures such that the halogen compounds within the envelope condenses at these remote locations, thereby effectively reducing the desired lumen maintenance of the light source.

The inner chamber 46 of the light source provide a a desired operating temperatue for its halogen compound and a desired temperature gradient which reduces the detrimental effects of the cold spots while not exceeding the maximum operating temperature of the light source 16. The desired temperature gradient is provided by having more uniform distances between the side, upper and lower portions of the inner chamber 46 relative to the filament which, in turn, results in a more uniform bulb wall temperature thereby reducing the temperature differences along locations within inner chamber 46 which would otherwise contribute to the occurrence of the cold spots. All these accomplishments are yielded without resulting to the commonly employed technique of increasing the inner diameter of the inner envelope.

The inner envelope 16 of FIGS. 1 and 2 has typical values given in Table 1.

TABLE 1

| | |
|---|---|
| Diameter 47 of the tubing to be pinched | about 7 mm to about 15 mm |
| Maximum Inner Diameter 49 of Chamber 46 | about 9 mm to about 17 mm |
| Wall Thickness of Light Source 16 | about 0.7 mm to about 1.1 mm |
| Length 51 of Light Source 16 | about 18 mm to about 45 mm |
| Operating Temperature of Light Source | about 350° C. to about 650° C. |

In accordance with the practice of the present invention light source 16 having an initial inner diameter 47 of 10.5 mm, and a maximum diameter 49 of 12.5 mm was fabricated. An assembly having rod-like members for supporting the filament 18, all described with regard to FIG. 1, was inserted into the light source. Sensors were attached to the peripheral of outer walls of the light source and the filament was energized for a period of 1 hour. The temperature distribution along the outside of the walls related to the inner chamber 46 were recorded and compared to the temperature distribution along the outer walls of light source not having the benefits of the present invention. The sensed temperatures of light source 16 showed a substantially uniform bulb wall temperature distribution in which the temperature gradient of the inner chamber 46 was reduced by 20% relative to the prior art light sources. This uniform bulb wall temperature distribution of the light source provides a desired operating environment for the halogen compound within its chamber.

It should now be appreciated that the present invention provides for an improved light source in which its halogen compound is efficiently operated. As previously discussed with regard to the shape of the inner chamber, this efficient operation of the halogen is achieved without any increases in the diameter of the light source which would otherwise increase the mass of the light source. Obtaining a desired halogen operation without increases of the mass of the light source reduces the complexity of mounting the light source within the outer envelope. For example, if the selected diameter of the light source was increased from 10.5 to 12.5 mm to accommodate a wattage increase of the light source from 50 to 90, the rigidity of mounting members 22, 24, 32 and 34 would have to be increased to handle a 21% increase in mass. Accordingly, by the practice of the present invention the selected diameter of the light source having the desired temperature gradient is maintained at its value of 10.5 mm while the wattage is increased from 50 to 90 and thus any increased mounting complexity is eliminated.

Figure 3B:
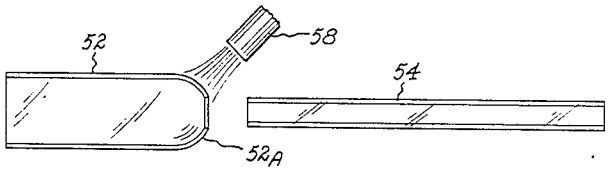
Figure 3C:
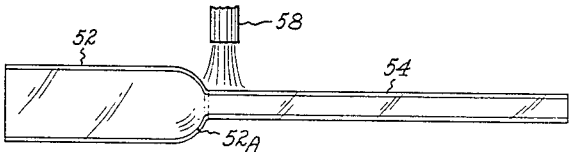
Figure 3D:
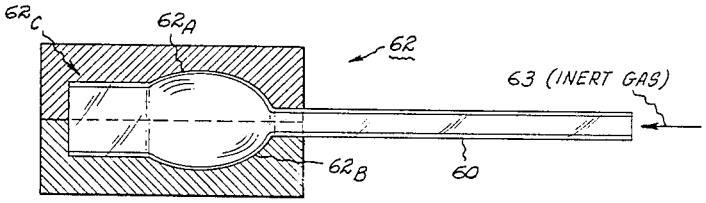
Figure 3E:
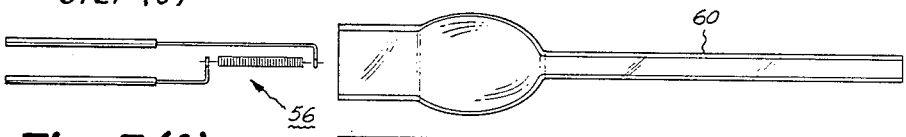
Figure 3F:
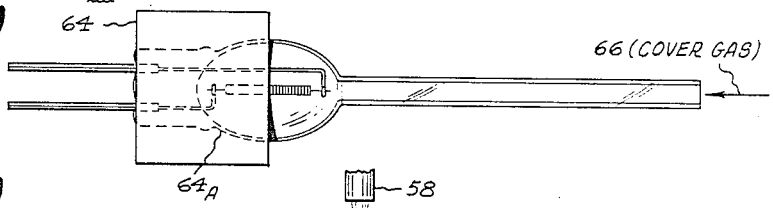
Figure 3G:
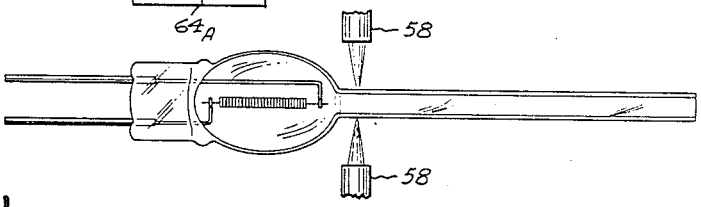
Figure 3H:
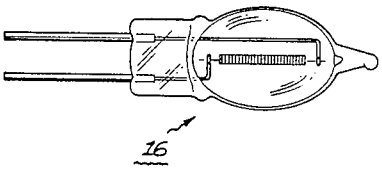

The light source 16 having the desired temperature gradient may be formed in accordance with the method of the present invention illustrated in FIG. 3. FIG. 3 illustrates a method having steps (*a*)–(*h*) shown in FIGS. 3(*a*)–3(*g*), respectively, and with the final light source 16 being shown in FIG. 3(*h*).

Step (a) is illustrated as providing a first light-transmissive tubular member 52, a second light-transmissive tubular member 54 and an assembled filament structure 56 which may be comprised of elements 18, 28, and 30.

The first tubular member 52 has a preselected inner diameter, previously discussed with regard to diameter 47 of FIG. 2, and is open at both ends. The first member 52 is to primarily form the light source 16 of the present invention. The inner diameter of the tubular member 52 may be preferably in the range of 9.0 millimeters to 14.5 millimeters. The second tubular member 54 is open at both ends. The second member 54 has an inner diameter sufficient to allow it to serve as an exhaust tube during the fabrication of the light source 16.

FIG. 3(*b*) illustrates step (*b*) in which the upper portion $52_A$ of the tubular member 52 is subjected to heat applied by a heating device 58 so as to soften and cause the upper portion $52_A$ to seek and obtain a dome-like shape with a radius of curvature substantially corresponding to the radius of curvature $48_A$ of the light source 16.

Step (*c*) is illustrated in FIG. 3(*c*) in which the lower portion of the second tubular member 54 is mated with the dome portion $52_A$ while heat is applied, via the device 56, to the mated portions thereby fusing them together as a composite member. The fused members are shown in FIG. 3 (*d*) as one composite member 60. In preparation for its molding process of FIG. 3 (*d*), the member 60 is preheated to a temperature in the range of 1350° C.–1500° C. for #180 glass. This range would be increased or higher for fused silica.

FIG. 3(*d*) shows step (*d*) in which the member 60 is placed into a mold 62. The mold 62 has side portions $62_A$ and $62_B$ each with a contoured shape which is substantially the same as the contoured shape 50 of the upper, side and lower walls of the light source 16. The mold 62 further has a closed portion $62_C$ which provides complementary mating with the lower open portion of the composite member 60. After the member 60 is placed into the mold 60, an inert gas 63 is applied to member 60 having a sufficient pressure in the range of 10 psi to 30 psi, to cause the member 60 to expand and its side walls to respectively take the shape of the side portions $62_A$ and $62_B$ of the mold 62. The member 60 now having its side walls expanded to the desired contoured shape 50 of inner chamber 46 is then removed from the mold 62.

FIG. 3(*e*) shows step (*e*) in which the filament assembly 56 initially located outside of the shaped-member 60 is placed into and spatially disposed within the central portion of the member 60.

FIG. 3(*f*) shows step (*f*) in which the lower neck portion of the member 60 having the arranged filament assembly 56 is placed into a pinch mold 64. The pinch mold 64 has an upper portion 64*A* with a predetermined radius of curvature corresponding to the predetermined radius of curvature 48*B* of the inner chamber 46. Before the mold is placed around the tubular member 60, heat is applied to the lower portion of the member 60 at a predetermined rate in the range of 1350° C. to 1500° C. At the same time a cover gas, typically comprised of $N_2$, is applied via the upper open portion of member 60 so as to flow over the filament assembly and prevent oxidization of the filament. The mold 64 is then closed with predetermined pressure after the member 60 is heated to cause the pinching and sealing of the members 28 and 30 within the pinch seal 36 shown in FIG. 2. After the mold 64 is closed, 10–30 psi of cover gas 66, is puffed into member 60 so that member 60 is blown out to fill mold 64. During the sealing and pinching process, the lower end portion of the member 60 takes the shape of the predetermined radius of curvature $64_A$ of the pinch mold 64 after the pinch seal mold closes.

After exhausting and then filling the inner confines of member 60 with the halogen compound and fill-gas, the member 60 is tipped-off as shown in FIG. 3 (*g*) for step (*g*) in which heat is applied via the devices 58 causing the tipping-off or severing of the fused portions of member 60.

The finished light source 16 of the method of steps (*a*)–(*g*) is shown in FIG. 3(*h*).

The method of the present invention further contemplates that the structural members 28 and 30 sealed in the pinch 36 of the light source 16 be connected to one side of the electrical connection to the conductive base 14 of FIG. 1. This one side of this electrical connection is shown in FIG. 1 via cross-members 32 and 34, which, in turn, are connected to the appropriate electrical connections of base 14 by way of electrical member 22 and 24 protruding out of the stem 26. However, if a voltage reducing means is lodged in the housing 20 to accommodate a specially adapted low voltage filament, the electrical members are connected to appropriate portions of the voltage reducing means.

The light source 16 and glass stem 26 are then spatially disposed within the outer envelope 12. The electrical members 22 and 24 are then connected to either the voltage reducing means or the electrically conductive base 14. The outer envelope may then be sealed to the base 14.

It should be appreciated that the method described with regard to FIG. 3 is accomplished by having an initial diameter size selected for the light source 16 that is substantially maintained throughout the process thereby reducing the amount of quartz or glass material necessary to form the light source. Further, the diameter of the light source 16 is maintained and thereby eases the pinching process associated with the present invention. The present invention provides for a more uniform operating temperature for the light source 16 so as to accommodate high wattage rating for related lamps without the need of increasing the diameter of the light source, thus negating the need to increase the mass of the inner envelope so as to allow for more easily mounting of the more uniform temperature operating light source 16 within the outer envelope 12.

It should be further appreciated that although the inner envelope of the present invention has been described for usage in a general service incandescent lamp, the usage of the light source 16 for other type lamps is contemplated by the practice of an invention. For example, the light source 16 may serve as a light source for PAR, reflector, automotive, photographic and display lamps each having appropriate means for mounting of the light source.

What we claim as new and desire to secure by Letters Patent of the United States is:

1. A method of manufacture of a light source comprising a light-transparent envelope having an oblate ellipsoidal shape, and containing a halogen compound, a fill-gas, and a filament spatially disposed and supported therein, said envelope having a first predetermined diameter related to both its upper and lower inner wall portions, the surfaces of said upper walls being joined by a first predetermined radius of curvature and the surfaces of said lower walls being joined by a second predetermined radius of curvature, said light source having a minor axis with a second predetermined diameter related to the central portion of its side walls, said upper, side and lower walls being joined together with a contoured shape, said method comprising the steps of:

(a) providing (1) a first light-transmissive tubular member open at both ends and having said first predetermined diameter, said first member to primarily serve as the housing for said light source; (2) a second light-transmissive tubular member open at both ends, said second member having a diameter sufficient to serve as an exhaust tube during the method of forming said light source; and (3) a filament assembly having electrical members;

(b) heating said first member to soften one end so as to cause it to become a dome-like shape with a radius of curvature substantially corresponding to said first predetermined radius of curvature;

(c) mating one end of the said second tubular member with the dome portion of said first member while heating the mating portions thereby fusing them together as a composite member;

(d) applying heat at a predetermined temperature to said composite member and then placing the composite member into a mold having side portions each with a contoured shape which is substantially the same as said contoured shape joining the upper, side and lower walls of said light source, said mold further having a closed portion which complementary mates with one end of the composite member, said mold being closed while at substantially the same time a gas is applied having a sufficient pressure to cause the composite member to expand and take the shape of the contoured shape of the said mold;

(e) removing said composite member from said mold and inserting said filament assembly having its structural members so as to be spatially disposed within the central portion of said composite member;

(f) applying heat at a predetermined temperature to the one end of said composite member while at the same time applying a cover gas which flows over and prevents oxidation of the filament, and then placing the one end of the composit,e member into a pinch mold having an upper portion with a predetermined radius of curvature corresponding to said second predetermined radius of curvature of said lower walls of said light source, said pinch mold being closed causing the pinching of said composite member and the sealing of said structural members of said filament assembly with said composite member while at the same time a gas at a sufficient pressure is puffed through the open portion of said composite member so that said one end of said composite member takes the shape of the predetermined radius of curvature of said pinch mold; and (g) removing said composite member from said pinch mold and after exhausting and then filling the inner confines of the composite member with said halogen compound and fill-gas, heat being then applied to the fused portions of said composite member causing the upper portion of the composite member to be severed.

* * * * *